US005769622A

United States Patent [19]

Aoki et al.

[11] Patent Number: 5,769,622

[45] Date of Patent: Jun. 23, 1998

[54] GAS COMBUSTION APPARATUS

[75] Inventors: Yutaka Aoki; Kouichi Mitsufuji; Tetsuya Ohara, all of Atsubetsu-ku, Japan

[73] Assignee: Paloma Industries, Ltd., Aichi Perfecture, Japan

[21] Appl. No.: 705,055

[22] Filed: Aug. 29, 1996

[30] Foreign Application Priority Data

Nov. 15, 1995 [JP] Japan ..... 7-322253

[51] Int. Cl.[6] ..... F23N 5/10

[52] U.S. Cl. ..... 431/80; 431/78; 126/374

[58] Field of Search ..... 431/18, 75, 77, 431/78, 80, 23; 126/374

[56] References Cited

U.S. PATENT DOCUMENTS

| | | | |
|---|---|---|---|
| 3,174,534 | 3/1965 | Weber | 431/44 |
| 3,174,535 | 3/1965 | Weber | 431/44 |
| 4,565,519 | 1/1986 | Carignan | 431/80 |
| 4,984,981 | 1/1991 | Pottebaum | 431/80 |
| 5,599,181 | 2/1997 | Aoki et al. | 431/80 |

FOREIGN PATENT DOCUMENTS 6-26653 6/1994 Japan .

*Primary Examiner*—Carl D. Price
*Attorney, Agent, or Firm*—Robin, Blecker & Daley

[57] ABSTRACT

A gas combustion apparatus comprises a burner, a thermal electric power generation element that uses the burner's combustion to produce a thermoelectromotive force, a voltage boosting circuit that raises the voltage of the thermoelectromotive force by the oscillation of an oscillation unit and a storage battery that is charged by the voltage-increased thermoelectromotive force. The oscillation unit consists of free running multivibrators and oscillates in dependence on the resistance of a positive temperature coefficient thermistor. If the positive temperature coefficient thermistor reaches a prescribed temperature or shorts out and fails, its resistance value changes and the oscillator unit stops its oscillation, whereby in the voltage boosting circuit the voltage rise stops, and electromagnetic safety valve closes.

13 Claims, 3 Drawing Sheets

GAS COMBUSTION APPARATUS

FIELD OF THE INVENTION

This invention relates generally to a gas combustion apparatus, and pertains more particularly to a gas combustion apparatus having an electromagnetic safety valve that detects overheating by a positive temperature coefficient thermistor and cuts off the supply of gas.

BACKGROUND OF THE INVENTION

It has long been known that gas tabletop heaters come with a safety device for preventing tempura fires. For example, in Laid-Open Japanese Patent Application No. Hei 6-26653, as shown in FIG. 3, there is disclosed a gas control circuit 30 of a gas tabletop heater 3 to which are connected, in series, a thermocouple 33 that generates thermoelectromotive force using the combustion of a combustion burner 38, an exciting coil 32*a* of an electromagnetic safety valve 32, and a positive temperature coefficient thermistor 31 that touches the base of a pot and whose resistance increases as the temperature rises. Normally the electromagnetic safety valve 32 is kept open by the thermoelectromotive force of the thermocouple 33, but when the base of the pot overheats and reaches a set temperature, then the resistance of the positive temperature coefficient thermistor 31 increases rapidly, the current flowing through it decreases, and the electromagnetic safety valve 32 closes.

Or, in another type, a gas tabletop heater 4 is known that comes with a control circuit that monitors the temperature of the base of a pot, as shown in FIG. 4. This type of heater is equipped with a combustion burner 48, a thermocouple 43 that generates thermoelectromotive force using its combustion heat, an electromagnetic safety valve 42, an exciting coil 42*a*, a negative temperature coefficient thermistor 41, a control circuit 40, and a battery 45. The control circuit 40 detects the thermoelectromotive force of the thermocouple 43 and keeps the electromagnetic safety valve 42 open, and when the base of the pot overheats and reaches a set temperature, the resistance of the negative temperature coefficient thermistor 41 decreases to below a prescribed value, the control circuit detects this and closes the electromagnetic safety valve 42 by cutting off the current to it. The electric power consumed by the control circuit 40 and the electromagnetic safety valve 42 is supplied by the battery 45.

But the gas tabletop heater 3 that uses a positive temperature coefficient thermistor 31 will of course not function properly if the positive temperature coefficient thermistor 31 shorts out and fails. That is, with the gas tabletop heater 3, the resistance value of the positive temperature coefficient thermistor 31 will not change but will remain at zero even if the base of the pot overheats, so that the electromagnetic safety valve 32 will never close, combustion will continue, and the base of the pot will keep getting hotter, thereby creating a hazard. In this state, a short-circuit cannot be detected, so in order to detect a short-circuit, thought is given to installing an electric-current fuse 36 in series with this control circuit 30, but it is difficult, just by installing an electric-current fuse 36, to ensure that the electric-current fuse 36 melts and breaks the circuit even if the positive temperature thermistor 31 shorts out and fails. This is because if the thermoelectromotive force is insufficient, then even if the resistance of the positive temperature coefficient thermistor 31 goes to zero because of a short-circuit failure, the melting cutoff current of the electric-current fuse 36 will not be reached, because of the resistance of the exciting coil 32*a* of the electromagnetic safety valve 32 and of the electric-current fuse 36.

In FIG. 3, increasing the number of thermocouples (for example, using a thermocouple integrated element) to ensure that the thermoelectromotive force that is generated increases and the electric-current fuse 36 melts, not only increases the cost but also increases the resistance of the thermocouples themselves. And of course, there are limits to reducing the resistance of the exciting coil 32*a* and the thermocouple 33 in order to increase the current flowing through the electric-current fuse 36 without causing an increase in the thermoelectromotive force. Even by using an electric-current fuse 36 that melts at a low current, there is danger that the cost will increase and that the fuse will mistakenly melt when no short-circuit failure has occurred.

With respect to the gas tabletop heater 4 of FIG. 4, one could install a detector 40*a* on the control circuit 40 in order to monitor the voltage at both ends of the negative temperature coefficient thermistor 41 in order to detect a short-circuit failure, so that when a short-circuit failure occurs with the negative temperature coefficient thermistor 41, the short-circuit is reported and the electromagnetic safety valve 42 is not opened. But because a battery 45 is used as the power source, the battery 45 must be replaced every time it wears out, making it inconvenient to use. Installing a detector 40*a* also makes the composition more complex.

The purpose of this invention is to solve the above problems by providing a gas combustion apparatus that ensures safety with a simple construction whereby the electromagnetic safety valve is closed if the base of the pot overheats or if a short-circuit failure occurs in the thermistor.

SUMMARY OF THE INVENTION

In accordance with the principles of the present invention, the above and other objectives are realized in a gas combustion apparatus comprising a burner that burns fuel gas, a thermal power generation element that generates a thermoelectromotive force from the heat of combustion of the burner, an electromagnetic safety valve that is provided on the fuel gas path to the burner and that maintains an open-valve state only when current flows that is of at least the standard current value, a positive temperature coefficient thermistor that touches the base of an item to be heated, such as a cooking pot, and whose resistance increases as the temperature rises, a voltage boosting circuit that has an oscillation unit that oscillates in dependence on the resistance value of the positive temperature coefficient thermistor and whose oscillation stops when the positive temperature coefficient thermistor shorts out or when its resistance increases and reaches a prescribed value, and the oscillation of this oscillation unit raises the voltage of the thermoelectromotive force generated from the thermal power generation element and causes more than a standard current value to flow to the electromagnetic safety valve, and a storage battery that is charged by the power from the voltage boosting circuit and serves as its power source.

The gas combustion apparatus of the present invention has an oscillation unit in the voltage boosting circuit. Because stable oscillation occurs and the thermoelectromotive voltage is raised in dependence on the resistance of the positive temperature coefficient thermistor, if the positive temperature coefficient thermistor shorts out or its resistance increases and reaches a prescribed value, the oscillation stops or the oscillation state changes and the voltage rise automatically stops and an electromagnetic safety valve closes. Therefore not only is the flame automatically extinguished when, for example, cooking comes to an end or the base of the pot overheats, but also if the positive temperature coefficient thermistor shorts out and fails, the voltage rise likewise stops and the electromagnetic safety valve is made to close, ensuring safety. Moreover, the cost is low and the reliability is high because this is realized with a simple construction, without having to provide for a means to control the electromagnetic safety valve by detecting and evaluating changes in the resistance of the positive temperature coefficient thermistor.

And there is the further effect that because the storage battery is normally charged during combustion, unlike when dry cells are used, the battery does not wear out even when used continuously for a long time, and there is no need to replace batteries, making this battery easy to use.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
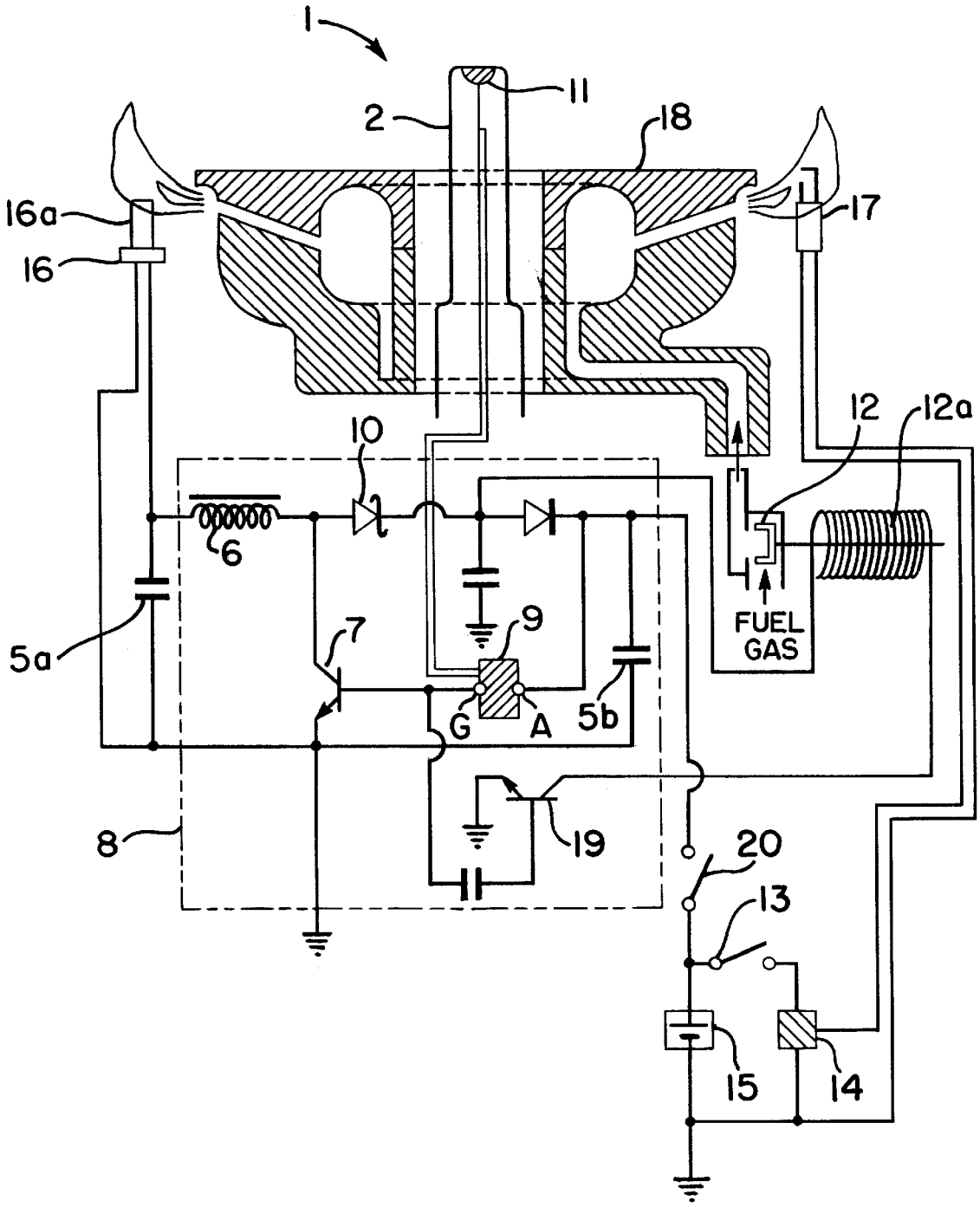
FIG. 1 is a simplified block diagram of a gas combustion apparatus as one working example.

The gas combustion apparatus of the present invention comprises a burner that burns fuel gas, a thermal power generation element that generates a thermoelectromotive force from the heat of combustion of the burner, an electromagnetic safety valve that is provided on the fuel gas path to the burner and that maintains an open-valve state only when current flows that is of at least the standard current value, a positive temperature coefficient thermistor that touches the base of the cooking pot and whose resistance increases as the temperature rises, a voltage boosting circuit that has an oscillation unit that oscillates in dependence on the resistance value of the positive temperature coefficient thermistor and whose oscillation stops when the positive temperature coefficient thermistor shorts out or when its resistance increases to a prescribed value, and the oscillation of this oscillation unit raises the voltage of the thermoelectromotive force generated from the thermal power generation element and causes more than a standard current value to flow to the electromagnetic safety valve, and a storage battery that is charged by the power from the voltage boosting circuit and serves as its power source.

In the gas combustion apparatus of the present invention, when the apparatus is ignited, the apparatus' heat of combustion generates a thermoelectromotive force from a thermal power generation element. Because the apparatus includes a storage battery as a power source controlling the current, this thermoelectromotive force is used as an excitation current for an electromagnetic safety valve, but in addition, because it is necessary to charge the storage battery, this thermoelectromotive force must be raised to a voltage that makes charging possible. Therefore a voltage boosting circuit is provided, and when this thermoelectromotive force is increased in voltage by the voltage boosting circuit and current flows to the electromagnetic safety valve, then the fuel gas path to the burner is held open. The combustion of the burner continues as long as the fuel gas path is held open. On the apparatus is a cooking pot in which cooking is done using this heat of combustion, and a positive temperature coefficient thermistor for detecting the temperature of the base of the cooking pot. The resistance of the positive temperature coefficient thermistor, which is in contact with the base of the pot, increases as the temperature of the base of the pot increases.

The voltage boosting circuit, which is equipped with an oscillation unit powered by a storage battery, makes use of the oscillation of the oscillation unit to increase the voltage of the thermoelectromotive force generated from the thermal power generation element. The oscillation unit oscillates in dependence on the resistance of the positive temperature coefficient thermistor, and its oscillation stops if the positive temperature coefficient thermistor shorts out or its resistance rises and reaches a prescribed value. Therefore when the oscillation stops, the increase in voltage automatically stops, and when the voltage rise stops, the current to the electromagnetic safety valve stops, and the open-valve state is no longer maintained. That is, the electromagnetic safety valve closes. Thus if, for example, the temperature of the base of the pot reaches a set temperature, the resistance value of the positive temperature coefficient thermistor reaches a prescribed value, and the increase in voltage comes to a stop, thereby closing the electromagnetic safety valve. In other words, the flame is automatically turned off when the cooking comes to an end or when the base of the pot overheats. And similarly when the positive temperature coefficient thermistor shorts out and fails, the voltage increase stops, and the electromagnetic safety valve is made to close.

Moreover, because the storage battery is constantly being charged during the combustion, it does not wear out with continued use as is the case with dry cells, and it is easy to use, with no need to replace batteries.

To further clarify the construction and use of the above-described invention, a preferred working example of the gas combustion apparatus of the present invention is described as follows along with reference to the drawings.

FIG. 1 is a simplified block diagram of a gas combustion apparatus in accordance with the principles of the present invention. The gas combustion apparatus 1 has a burner 18 that burns a mixed gas of fuel gas and air, a thermal electric power generation element 16 that generates thermoelectromotive force using its combustion, a voltage boosting circuit 8 that increases the voltage of the thermoelectromotive force, and a storage battery 15 that is charged by the thermoelectromotive force when the voltage is raised. In the middle of burner 18 is temperature sensor 2, inside of which is a PTC thermistor 11, which is a positive temperature coefficient thermistor connected to the voltage boosting circuit 8. A heat sensor 16*a* of a thermal electric power generation element 16 faces the flame of the burner 18 and is connected to the voltage boosting circuit 8. A capacitor 5*a* for the purpose of stabilizing the thermoelectromotive force that is generated by the heat sensor 16*a* is installed in parallel between the thermal electric power generation element 16 and the voltage boosting circuit 8. An igniter 14, which generates a high voltage, a switch 13, which opens and closes the supply circuit to the igniter 14, and an electrode 17, which discharges a spark as a discharge when a high voltage is applied, are connected to the storage battery 15.

When a cooking pot is placed on the burner 18, a temperature sensor 2 comes into contact with the base of the pot and its heat is transmitted to the PTC thermistor 11, whose resistance is thereby altered.

In the gas combustion apparatus 1, when the valve part of electromagnetic safety valve 12 is opened by pushing with a spindle (not shown) in the ignition operation when combustion begins, the switch 13 is closed, the igniter 14 is made to operate by the electric power stored in the storage battery 15, and the fuel gas is ignited by the electrical discharge of the electrode 17 to which a high voltage is applied by the igniter 14. This ignition causes the thermal power generation element 16 to emit a thermoelectromotive force. As the voltage of the thermoelectromotive force is raised by the voltage boosting circuit 8 and current flows to the electromagnetic safety valve 12, the storage battery 15 is simultaneously charged. In this state, the electromagnetic safety valve 12 is held open even after the ignition operation ends and the spindle is withdrawn, and a state results in which the valve can be closed by stopping the current.

The storage battery 15, which is provided as a power source for current control, is charged using a minute amount of thermoelectromotive force, so it is necessary to raise the thermoelectric force to a voltage that allows the charging to take place. The voltage boosting circuit 8 is provided for this purpose. The voltage boosting circuit 8 has an oscillation unit 9 that generates an oscillation signal, a transistor 7 that performs switching operations by the oscillation signal, and a coil 6 that boosts the output voltage of the thermal electric power generation element 16 according to the switching operation. On the secondary side of this coil 6 is a Schottky diode 10 that rectifies the coil's current. The rectified coil current is charged into a smoothing capacitor 5*b* and the storage battery 15 that is connected in parallel. The electric power that is needed for oscillation of the oscillation unit 9 when ignition begins is supplied from this storage battery 15.

An exciting coil 12*a* of the electromagnetic safety valve 12 and a transistor 19 are connected in series to the secondary side of the coil 6, the oscillation signal from a terminal G of an oscillation unit 9 is input to the base of the transistor 19, and while it oscillates, the transistor 19 is on and the coil current flows into the exciting coil 12*a,* and when the oscillation stops, the transistor 19 goes off, the coil current no longer flows into the exciting coil 12*a,* and the electromagnetic safety valve 12 closes.

Switch 20 is closed to supply electric power to booster circuit 8 during ignition and whenever the voltage of booster circuit 8 is higher than the voltage of battery 15 to allow the battery to be charged. Switch 20 is linked with switch 13 only during the ignition operation. Thus, during ignition, switch 20 is closed to provide electric power for battery 15 to the booster circuit 8 which is thereby caused to oscillate. When booster circuit 8 initially oscillates ignition occurs and a thermoelectric force is generated. After ignition is completed, switch 13 is turned off. However, a predetermined time after the ignition operation (determined by a timer which is not shown), the output voltage from the booster circuit 8 is compared to the voltage of the storage battery 15 by a comparison circuit (not shown) and the open or closed state of switch 20 is then determined by the comparison circuit. When the output voltage of booster circuit 8 is higher than the voltage of battery 15, switch 20 is kept closed to allow the battery 15 to be charged. If the output voltage of booster circuit 8 is lower than the voltage of battery 15, switch 20 is opened to prevent discharge of the battery 15.

Figure 2:
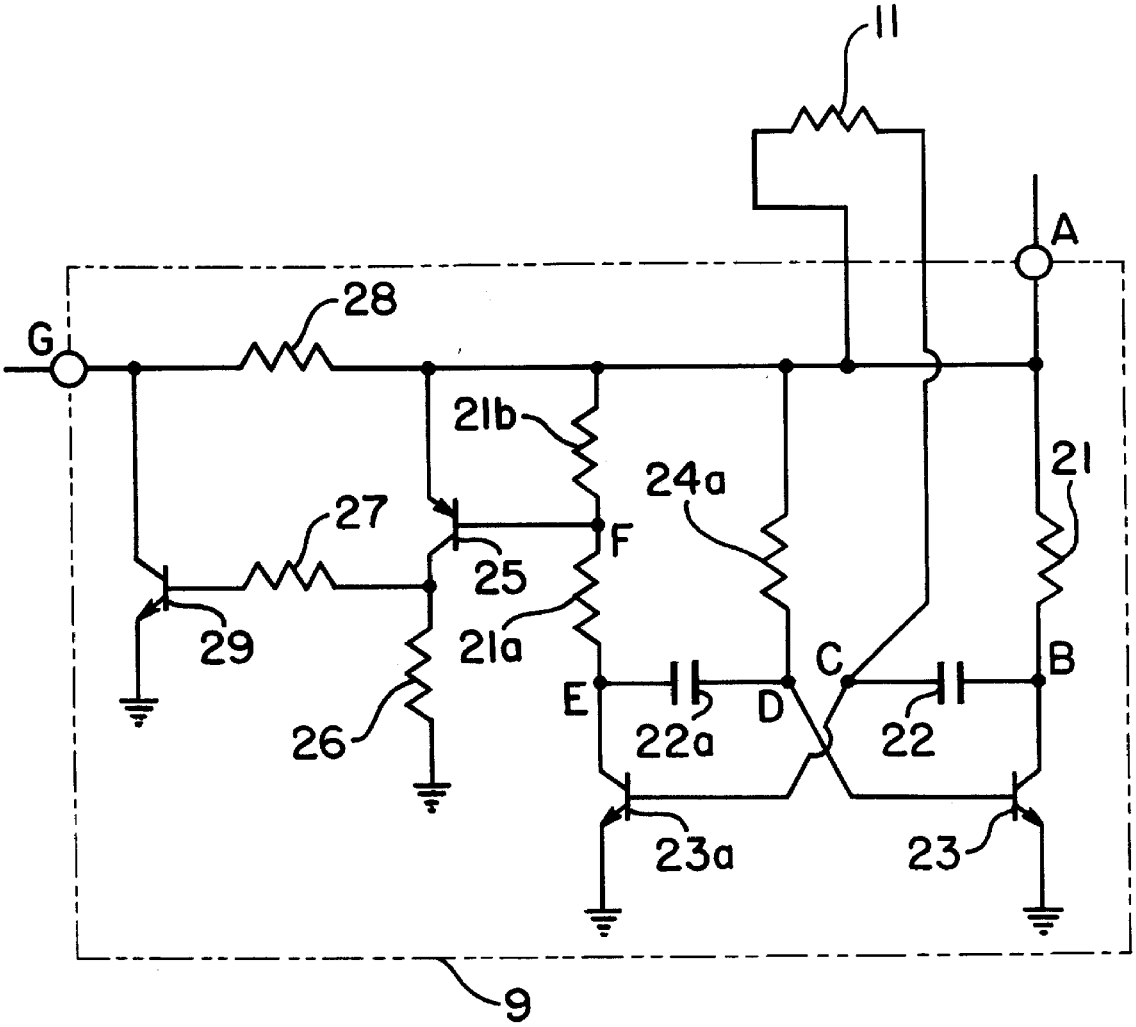
FIG. 2 is a simplified block diagram of an oscillation unit.
Figure 3:
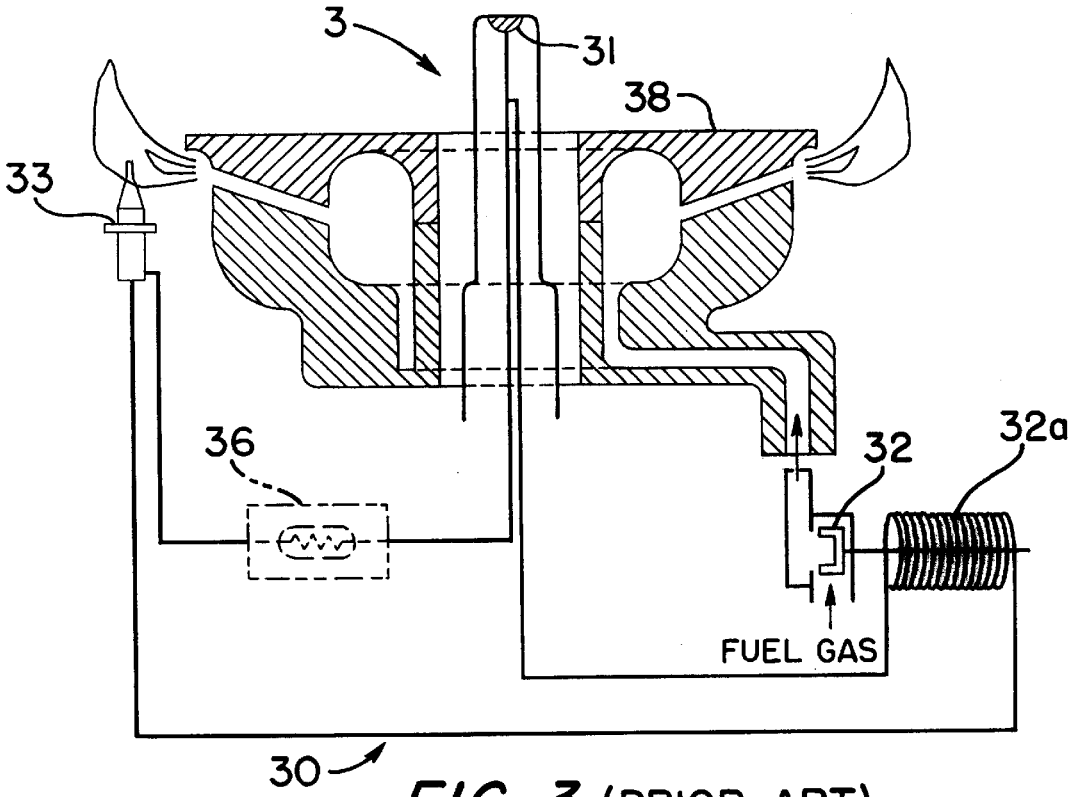
FIG. 3 (PRIOR ART)
FIG. 3 is a simplified block diagram of a gas tabletop heater as a conventional example.
Figure 4:
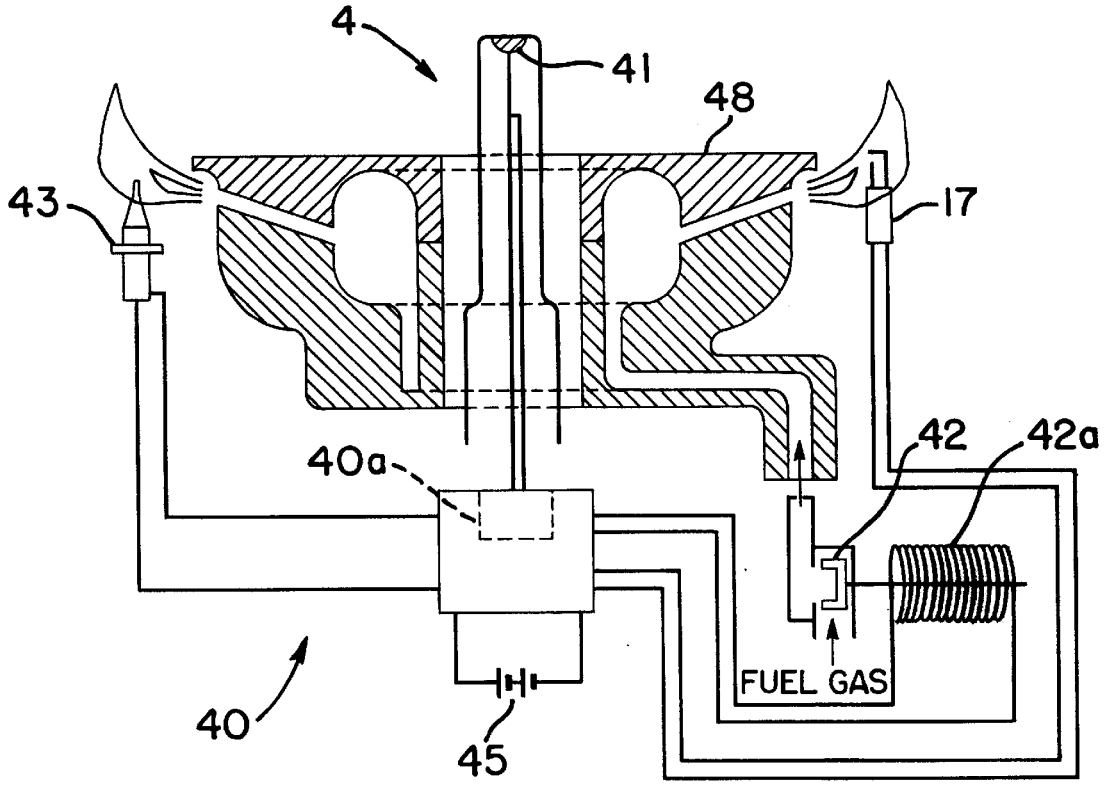
FIG. 4 (PRIOR ART)
FIG. 4 is a simplified block diagram of a gas tabletop heater as a conventional example.

As shown in FIG. 2, the oscillation unit 9 is made up of a free running multivibrator circuit and a pulse amplification circuit.

The free running multivibrator circuit is provided with two pairs of switching circuits. One switching circuit is comprised of a capacitor 22 which accumulates electric charge when the voltage of the storage battery 15 is applied from point A, a transistor 23, which is connected to the capacitor 22 (point B), which discharges the electric charge that has accumulated in the capacitor 22 when it is turned on and which, conversely charges the positive electrode before discharge, a limiting resistor 21 for the purpose of lowering the potential when the transistor 23 has been turned on and the PTC thermistor 11 that is installed between the capacitor (point C) and point A. The other switching circuit is, similarly, comprised of a capacitor 22*a* which accumulates electric charge when the voltage of the storage battery 15 is applied from point A, a transistor 23*a,* which is connected to the capacitor 22*a* (point E), which discharges the electric charge that has accumulated in the capacitor 22*a* when it is turned on and which, conversely, charges the positive electrode before discharge, a limiting resistor 21*a* for the purpose of lowering the potential when the transistor 23*a* has been turned on, a limiting resistor 21*b* and a resistor 24*a* that is installed between the capacitor 22*a* (point D) and point A. The capacitor 22 (point C) is connected to the base of the transistor 23*a* and the capacitor 22*a* (point D) is connected to the base of the transistor 23.

First, in the free running multivibrator circuit, when the voltage of the storage battery 15 is applied to point A, either point C or point D first reaches the threshold voltage, via a PTC thermistor 11 or a resistor 24*a*. If, for example, point C reaches the threshold voltage first, the transistor 23*a* goes on. Then points D and E discharge and go to level 0. If it is slow and point D reaches the threshold voltage, the transistor 23 goes on. Then points C and B discharge and go to level 0. By alternate repetition of this action, an intermittent pulse oscillation signal is emitted. This oscillation output is then output to point G via a pulse amplification circuit consisting of transistors 25 and 29 as well as other components. The pulse amplification circuit is comprised of the transistor 25, which is connected to point A, which is turned on by the pulse oscillation signal of the free running multivibrator circuit and which amplifies the signals, the transistor 29, which further amplifies the output of the transistor 25, a resistor 26, which stabilizes the base potential of the transistor 29 when the transistor 25 is turned on, a limiting resistor 27, which limits the base current of the transistor 29 and a limiting resistor 28, which limits the output current from point G. First, only when the transistor 23*a* is turned on, the potential at point F (the base potential of the transistor 25) decreases from the voltage at point A by greater than a specified amount (for example, 0.6V) and the transistor 25 is turned on. When the transistor 25 is turned on, the base current of the transistor 29 rises and the transistor 29 is turned on. In this way, pulse oscillation signals are output at point G when the transistor 23*a* is turned on.

The PTC thermistor 11 or resistor 24*a* controls the time until point C or point D reaches the threshold voltage, and a stable oscillation output can be obtained by their combination.

When the PTC thermistor 11 reaches the prescribed temperature, its resistance suddenly increases. A short circuit failure may also occur. In this state, points C and D reach the threshold voltage in alternation with good balance, and the oscillation unit 9 can no longer perform its switching operation, and the oscillation is stopped. The increase in voltage then stops too. At the same time, the transistor 19 goes off, the current to the exciting coil 12*a* of the electromagnetic safety valve 12 stops too, and the electromagnetic safety valve 12 closes.

Thus in this gas combustion apparatus 1, if the PTC thermistor 11 shorts out and fails or the temperature rises and its resistance reaches a prescribed value, even if a change in the resistance of the PTC thermistor 11 is not detected, then the oscillation automatically stops and the electromagnetic safety valve 12 is closed, so there is no need for a comparator circuit to compare the detected resistance of the PTC thermistor 11 with the prescribed resistance and make a determination, nor for a control circuit for controlling the current to exciting the coil 12*a* based on this comparison.

And because the storage battery 15 is normally charged by electric power supplied from the thermal electric power generation element 16 during combustion, unlike dry cells, the battery does not wear out even when used continuously for a long time, and there is no need to replace batteries, making this battery easy to use.

The foregoing is a description of a working example of this invention, but this invention is not limited to this working example but rather can be embodied in various ways, as long as they do not depart from the purport of this invention.

In all cases it is understood that the above-described arrangements are merely illustrative of the many possible specific embodiments which represent applications of the present invention. Numerous and varied other configurations, can be readily devised in accordance with the principles of the present invention without departing from the spirit and scope of the invention.

What is claimed is:

1. A gas combustion apparatus comprising:

a burner for burning fuel gas;

ignition means for igniting the burner;

a battery for providing power to the ignition means;

a fuel gas supply line for providing the fuel gas to the burner;

an electromagnetic safety valve provided on the fuel gas supply line for selectively closing the fuel gas supply line;

a thermal power generation element for generating a thermoelectromotive force from heat generated by combustion of the fuel gas at the burner;

a variable resistance element for providing a variable resistance; and a voltage boosting circuit connected to the thermal power generation element, to the battery and to the electromagnetic safety valve, the voltage boosting circuit having an oscillation unit; wherein:

the oscillation unit is maintained in an oscillating condition so long as combustion of fuel gas by the burner is taking place and the resistance provided by the variable resistance element is less than a given value and the variable resistance level is not shorted out; and so long as the oscillation unit is in the oscillating condition, the oscillation unit raises a voltage of the thermoelectromotive force generated by the thermal power generation element to provide a voltage-boosted electromotive force for charging the battery and to provide a current flow at a predetermined level to the electromagnetic safety valve; the electromagnetic safety being maintained in an open condition only if the current flow is provided to the electromagnetic safety valve at a level at least as high as the predetermined level.

2. A gas combustion apparatus in accordance with claim 1 wherein said variable resistance element is a temperature sensor for sensing a temperature of an item to be heated.

3. A gas combustion apparatus in accordance with claim 2, wherein said temperature sensor is a positive temperature coefficient thermistor in contact with the item to be heated, said positive temperature coefficient thermistor providing a resistance which increases with a rise in the temperature of the item to be heated.

4. A gas combustion apparatus in accordance with claim 3, wherein said oscillation unit does not oscillate when the positive temperature coefficient thermistor shorts-out or when the resistance provided by the positive temperature coefficient thermistor is equal to or greater than the given value.

5. A gas combustion apparatus in accordance with claim 4, wherein said oscillation unit generates an oscillation signal and said voltage boosting circuit further includes a transistor for performing switching operations in response to the oscillation signal, a coil for boosting an output voltage of the thermal power generation element according to the switching operations of the transistor, a Schottky diode for rectifying a current output from the coil, and a smoothing capacitor charged by the rectified current provided by the Schottky diode.

6. A gas combustion apparatus in accordance with claim 5, wherein said oscillation unit comprises a free running multivibrator circuit and a pulse amplification circuit.

7. A gas combustion apparatus in accordance with claim 1, wherein said battery selectively serves as a power source for triggering the voltage boosting circuit.

8. A gas combustion apparatus comprising:

a burner for burning fuel gas;

ignition means for igniting the burner;

a battery for providing power to the ignition means;

a fuel gas supply line for providing the fuel gas to the burner;

an electromagnetic safety valve provided on the fuel gas supply line for selectively closing the fuel gas supply line;

a thermal electric power generation element for generating a thermoelectric force from heat generated by combustion of the fuel gas at the burner; and a voltage boosting circuit connected to the thermal electric power generation element, to the battery and to the electromagnetic safety valve, the voltage boosting circuit having an oscillation unit for providing an oscillation to increase a voltage of the thermoelectromotive force generated by the thermal electric power generation element, the voltage-increased thermoelectromotive force being supplied to the battery to charge the battery and also supplying a current flow to the electromagnetic safety valve to maintain the valve in an open condition, the voltage boosting circuit also having a temperature sensor for sensing a temperature of an item and for selectively disabling the oscillation unit according to the sensed temperature of the item.

9. A gas combustion apparatus in accordance with claim 8, wherein the item which has its temperature sensed by said temperature sensor is a pot heated by the burner, and said temperature sensor is a positive temperature coefficient thermistor in contact with a base of the pot, said positive temperature coefficient thermistor providing a resistance which increases with a rise in the temperature of the pot.

10. A gas combustion apparatus in accordance with claim 9, wherein said oscillation unit oscillates in dependence on the resistance provided by the positive temperature coefficient thermistors and the oscillation unit stops oscillating when the positive temperature coefficient thermistor shorts-out or when the resistance provided by the positive temperature coefficient thermistor increases and reaches a prescribed value, the electromagnetic safety valve being closed when the oscillation unit stops oscillating.

11. A gas combustion apparatus in accordance with claim 10, wherein said oscillation unit generates an oscillation signal and said voltage boosting circuit further includes a transistor for performing switching operations in response to the oscillation signal, a coil for boosting an output voltage of the thermal electric power generation element according to the switching operations of the transistor, a Schottky diode for rectifying a current output from the coil, and a smoothing capacitor charged by the rectified current provided by the Schottky diode.

12. A gas combustion apparatus in accordance with claim 11, wherein said oscillation unit comprises a free running multivibrator circuit and a pulse amplification circuit.

13. A gas combustion apparatus in accordance with claim 12, wherein said battery selectively serves as a power source for triggering the voltage boosting circuit.

* * * * *